US009027713B2

(12) United States Patent
Husmann

(10) Patent No.: US 9,027,713 B2
(45) Date of Patent: May 12, 2015

(54) DOUBLE-DECKER ELEVATOR INSTALLATION

(75) Inventor: Josef Husmann, Lucerne (CH)

(73) Assignee: Inventio AG, Hergiswil (CH)

( * ) Notice: Subject to any disclaimer, the term of this patent is extended or adjusted under 35 U.S.C. 154(b) by 399 days.

(21) Appl. No.: 13/314,539

(22) Filed: Dec. 8, 2011

(65) Prior Publication Data

US 2012/0152657 A1 Jun. 21, 2012

(30) Foreign Application Priority Data

Dec. 21, 2010 (EP) ..... 10196118

(51) Int. Cl.
*B66B 9/04* (2006.01)
*B66B 1/42* (2006.01)

(52) U.S. Cl.
CPC ..... *B66B 1/425* (2013.01)

(58) Field of Classification Search
CPC ..... B66B 1/425
USPC ..... 187/249, 291
See application file for complete search history.

(56) References Cited

U.S. PATENT DOCUMENTS 5,220,981 A * 6/1993 Kahkipuro et al. ..... 187/249
2003/0164266 A1* 9/2003 Gallati et al. ..... 187/284

FOREIGN PATENT DOCUMENTS

JP 2001322771 A1 11/2011
WO WO 0187756 A1 * 11/2001
WO WO 2011082896 A1 * 7/2011
WO WO 2011082898 A1 * 7/2011
WO WO 2011082899 A1 * 7/2011
WO WO 2012124067 A1 * 9/2012

OTHER PUBLICATIONS

English Machine Translation of WO 2011/082898.*

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

An elevator installation includes an elevator cage carrier with a first elevator cage and a second elevator cage. A hydraulic adjusting element for the first elevator cage is provided, which serves for adjusting the first elevator cage relative to the elevator cage carrier. In addition, a hydraulic adjusting element for the second elevator cage is also provided, which serves for adjusting the second elevator cage relative to the elevator cage carrier. In that case a stroke of the hydraulic adjusting element for the first elevator cage for adjusting the first elevator cage in a first adjustment direction is converted into a stroke of the hydraulic adjusting element for the second elevator cage for adjusting the second elevator cage in an opposite adjustment direction.

10 Claims, 1 Drawing Sheet

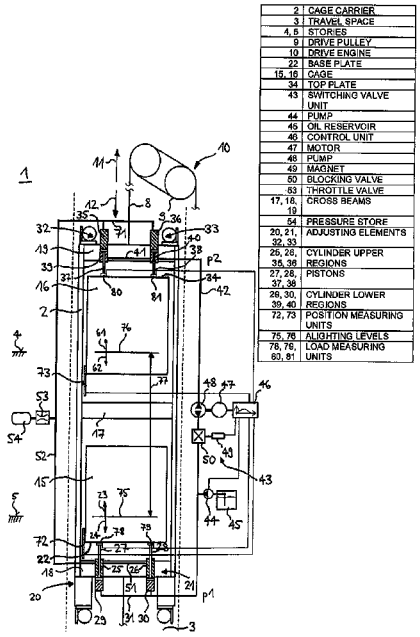

| | |
|---|---|
| 2 | CAGE CARRIER |
| 3 | TRAVEL SPACE |
| 4, 5 | STORIES |
| 9 | DRIVE PULLEY |
| 10 | DRIVE ENGINE |
| 22 | BASE PLATE |
| 15, 16 | CAGE |
| 34 | TOP PLATE |
| 43 | SWITCHING VALVE UNIT |
| 44 | PUMP |
| 45 | OIL RESERVOIR |
| 46 | CONTROL UNIT |
| 47 | MOTOR |
| 48 | PUMP |
| 49 | MAGNET |
| 50 | BLOCKING VALVE |
| 53 | THROTTLE VALVE |
| 17, 18, 19 | CROSS BEAMS |
| 54 | PRESSURE STORE |
| 20, 21, 32, 33 | ADJUSTING ELEMENTS |
| 25, 26, 35, 36 | CYLINDER UPPER REGIONS |
| 27, 28, 37, 38 | PISTONS |
| 29, 30, 39, 40 | CYLINDER LOWER REGIONS |
| 72, 73 | POSITION MEASURING UNITS |
| 75, 76 | ALIGHTING LEVELS |
| 78, 79, 80, 81 | LOAD MEASURING UNITS |

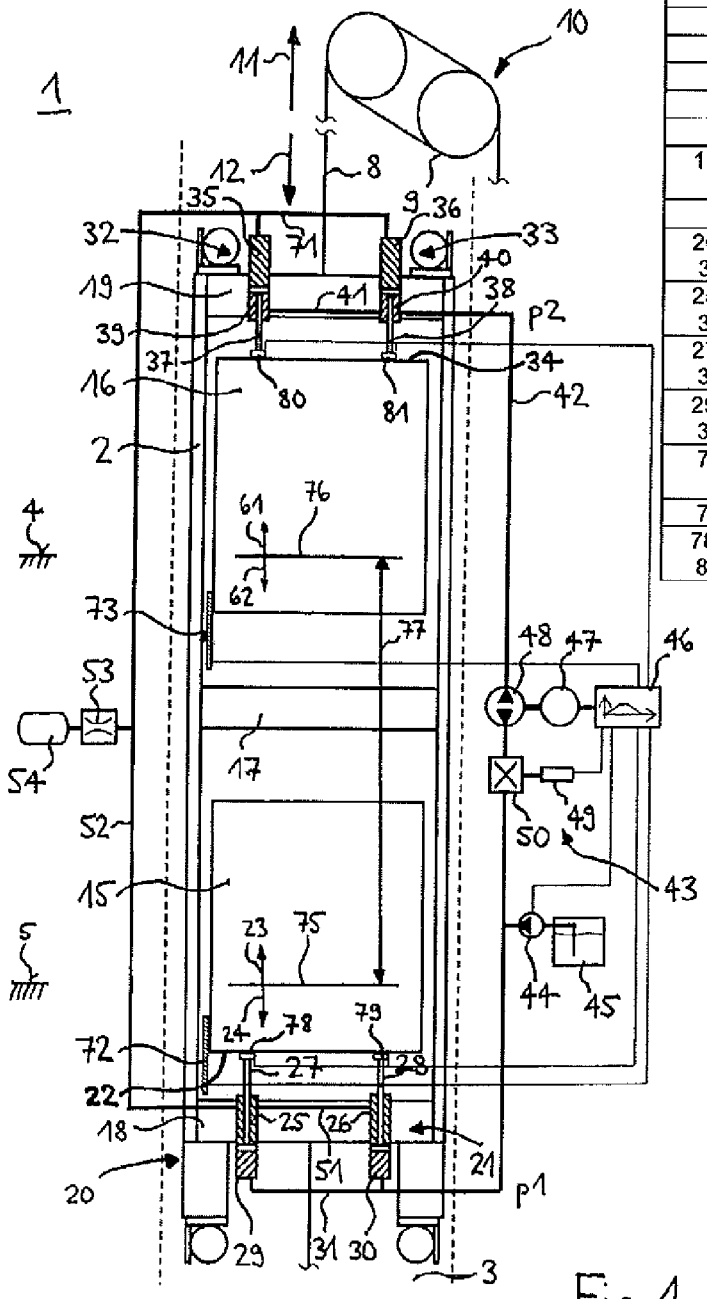

Fig. 1

DOUBLE-DECKER ELEVATOR INSTALLATION

CROSS-REFERENCE TO RELATED APPLICATION

This application claims priority to European Patent Application No. 10196118.3, filed Dec. 21, 2010, which is incorporated herein by reference.

FIELD

The disclosure relates to an elevator installation with at least one elevator cage carrier, which can receive two or more elevator cages (e.g., a so-called double-decker elevator installation).

BACKGROUND

A double-decker elevator is known from JP 2001-322771 A1. The known elevator comprises a cage frame in which two cages are arranged one above the other. In this regard, the upper cage is supported on the cage frame by way of a resilient body. The lower cage is supported on a base by way of a resilient body. The base is in turn supported on the cage frame by way of hydraulic oil cylinders. In this connection, the weight of the lower cage is measured. The oil pressure for the hydraulic oil cylinders is controlled in dependence on the weight of the lower cage.

The double-decker elevator known from JP 2001-322771 A1 has the possible disadvantage that the stroke of the hydraulic oil cylinders is limited and thus a possible adjustment travel for the lower cage is limited. In theory a relatively large adjustment travel for the lower cage is indeed also realizable for the lower cage by way of an appropriately large stroke of the oil cylinders, but in practice statics and safety oppose this. In particular, a sufficient level of safety should be ensured even during travel of the cage frame. Specifically, large forces can in the case of emergency braking act on the oil cylinders, which has to be taken into consideration in the construction.

SUMMARY

At least some of the disclosed embodiments comprise an elevator installation which enables a high level of operational safety and a wide range of use.

Particular embodiments comprise at least one elevator cage carrier, which is movable in a travel space provided for travel of the elevator cage carrier, a first elevator cage, which is arranged at the elevator cage carrier, and at least one second life cage, which is arranged at the elevator cage carrier. At least one hydraulic adjusting element for the first elevator cage is provided and serves for adjusting the first elevator cage relative to the elevator cage carrier. In addition, at least one hydraulic adjusting element for the second elevator cage is provided and serves for adjusting the second elevator cage relative to the elevator cage carrier. In that case a stroke of the hydraulic adjusting element for the first elevator cage for adjustment of the first elevator cage in a first adjustment direction is converted into a stroke of the hydraulic adjusting element for the second elevator cage for adjusting the second elevator cage in an opposite adjustment direction.

The elevator cage carrier of the elevator installation can be arranged, for example, in an elevator shaft. The travel space provided for travel of the elevator cage carrier is then bounded by the elevator shaft. In this regard, a drive engine unit can be provided which serves for actuating the elevator cage carrier. The elevator cage carrier is thereby movable along the provided travel path. The elevator cage carrier can be suspended at a traction means connected with the elevator cage carrier. The traction means can in this regard be guided in a suitable manner over a drive pulley of the drive engine unit. Such a traction means can also have the function, apart from the function of transmission of the force or the torque of the drive engine unit to the elevator cage carrier, of supporting the elevator cage carrier. By actuation of the elevator cage carrier there is to be understood, in particular, raising or lowering in the elevator shaft or the travel space provided for travel of the elevator cage carrier. The elevator cage carrier can be guided at one or more guide rails.

It can be advantageous if a possible stroke of the hydraulic adjusting element for the first elevator cage for adjustment of the first elevator cage is approximately the same amount as a possible stroke of the hydraulic adjusting element for the second elevator cage for adjustment of the second elevator cage. As a result, possible adjustment travels of approximately the same size can thereby be realized for the two elevator cages. This makes possible, in particular, an identical design of the components for the first elevator cage and the second elevator cage. In this regard, comparable forces act on the hydraulic adjusting element of the first elevator cage and the hydraulic adjusting element of the second elevator cage, whereby an optimized design results. An economic manufacture is thereby possible.

In some embodiments an adjustment direction for the first elevator cage in which the first elevator cage is adjustable by the hydraulic adjusting element for the first elevator cage and an adjustment direction for the second elevator cage in which the second elevator cage is adjustable by the hydraulic adjusting element for the second elevator cage are parallel to a travel direction of the elevator cage carrier in which the elevator cage carrier is movable through the travel space. In the case of acceleration and deceleration of the elevator cage carrier, forces which are similarly parallel to the travel direction thereby act on the elevator cage. A possible loading of the hydraulic adjusting elements for the elevator cages along the adjustment directions thereof is thereby given. A robust design is thus possible.

In further embodiments the hydraulic adjusting element for the first elevator cage in the case of adjustment of the first elevator cage relative to the elevator cage carrier is adjusted synchronously with the hydraulic adjusting element for the second elevator cage in an adjustment direction of the first elevator cage as well as in an adjustment direction of the second elevator cage. As a result, in the case of adjustment of the first elevator cage and the second elevator cage relative to the elevator cage carrier a weight distribution within the elevator cage carrier can always be achieved.

In additional embodiments, a hydraulic connection between the hydraulic adjusting element for the first elevator cage and the hydraulic adjusting element for the second elevator cage is provided. A pump is arranged in the hydraulic connection, wherein the pump for raising the first elevator cage or for raising the second elevator cage relative to the elevator cage carrier conveys from the hydraulic adjusting element for the first elevator cage to the hydraulic adjusting element for the first elevator cage.

Depending on the respective loading of the first or second elevator cage and adjusting device of the first or second elevator cage the power to be exerted by the pump varies in order to convey a pressure fluid from the hydraulic adjusting element of the first elevator cage to the adjusting element of the second elevator cage.

For example, in the case of higher loading of the first elevator cage a higher hydraulic pressure prevails in the hydraulic adjusting element of the first elevator cage than in the hydraulic adjusting element of the second elevator cage. The resulting load thus acts on the hydraulic adjusting element of the first elevator cage, so that the pressure fluid has a tendency to be displaced from the hydraulic adjusting element of the first elevator cage. For lowering of the first elevator cage the pump only has to exert a small output. In the case of a larger resultant load, even a throttling output is to be exerted by the pump in order to lower the first elevator cage in controlled manner. In that case, the second elevator cage is correspondingly raised. For raising of the first elevator cage against the resultant load, the pump thereagainst has to exert a greater output. In that case the second elevator cage is correspondingly lowered.

In some embodiments, a blocking valve is arranged in the hydraulic connection. In that case the pump conveys from the hydraulic adjusting element for the first elevator cage to the hydraulic adjusting element for the first elevator cage by way of the open blocking valve. Thereagainst, in a rest setting in which the first elevator cage and the second elevator cage are at rest relative to the elevator cage carrier, the blocking valve blocks the hydraulic connection. Thus, in the rest setting a reliable fixing of the first and the second elevator cages with respect to the elevator cage carrier can be achieved.

The blocking valve is also blockable particularly in the case of faulty functioning of the pump. In that case an undesired movement of the first and second elevator cages towards one another can be prevented. A high level of operational safety can thereby be achieved.

In further embodiments, the hydraulic adjusting element for the first elevator cage is arranged below the first elevator cage at a cross beam of the elevator cage carrier and the hydraulic adjusting element for the second elevator cage is arranged above the second elevator cage at a cross beam of the elevator cage carrier. In the case of an arrangement of the first elevator cage below the second elevator cage, the intermediate space between the first and second elevator cages remains free of adjusting elements and a smaller cage spacing between the first and second elevator cages is settable. This can enable use of the elevator installation in buildings with relatively small story heights.

BRIEF DESCRIPTION OF THE DRAWINGS

Exemplifying embodiments of the disclosed technologies are explained in more detail in the following description using the accompanying drawing, in which:

FIG. 1 shows an elevator installation in a schematic illustration in correspondence with an exemplifying embodiment of the disclosed technologies.

DETAILED DESCRIPTION

FIG. 1 shows an elevator installation 1 with at least one elevator cage carrier 2. The elevator cage carrier 2 is movable in a travel space 3 provided for travel of the elevator cage carrier 2. For example, the travel space 3 can be provided in an elevator shaft of a building. The travel space 3 is then bounded by such an elevator shaft. In this regard several stories 4, 5 can be provided in the building. The stories 4, 5 are arranged near the travel space 3. In this connection the stories 4, 5 represent examples for stopping points 4, 5. The stories 4, 5 are in that respect illustrated by way of example. In practice, a significantly larger number of stories or stopping points can be provided.

The elevator cage carrier 2 is suspended at a traction means 8. The traction means 8 runs at least around a drive pulley 9 of a drive engine unit 10. In correspondence with the instantaneous direction of rotation of the drive pulley 9 driven by the drive engine unit 10 the elevator cage carrier 2 is moved in a direction 11 upwardly or in a direction 12 downwardly. The elevator cage carrier 2 can thus be moved in the travel directions 11, 12 through the travel space 3.

The elevator cage carrier 2 serves for reception of a first elevator cage 15 and a second elevator cage 16. In this exemplifying embodiment the elevator cage carrier 2 receives the two elevator cages 15, 16.

The first elevator cage 15 is, in this exemplifying embodiment, arranged below the second elevator cage 16 in the elevator cage carrier 2. A cross beam 17 of the elevator cage carrier 2 is provided between the two elevator cages 15, 16. In addition, a further cross beam 18 of the elevator cage carrier 2 is provided below the first elevator cage 15. Moreover, a cross beam 19 of the elevator cage carrier 2 is provided above the second elevator cage 16. The traction means 8 can, for example, be fastened to the cross beam 19 of the elevator cage carrier 2.

Hydraulic adjusting elements 20, 21 are arranged between the first elevator cage 15 and the cross beam 18. The hydraulic adjusting elements 20, 21 are in this regard connected on the one hand with the cross beam 18 and on the other hand with a base plate 22 of the first elevator cage 15. The hydraulic adjusting elements 20, 21 serve for raising the first elevator cage 15 in an adjustment direction 23. Moreover, the first elevator cage 15 can be lowered in an adjustment direction 24 by appropriate activation of the adjusting elements 20, 21. An adjustment of the 30 first elevator cage 15 in the adjustment directions 23, 24 is thus possible. The adjustment directions 23, 24 are oriented oppositely to one another. Moreover, the adjustment directions 23, 24 are oriented parallel to the travel directions 11, 12 of the elevator cage carrier 2.

The adjusting device 23 points vertically upwardly, whilst the adjusting device 24 points vertically downwardly.

The hydraulic adjusting elements 20, 21 are designed as hydraulic oil cylinders. In that case, the hydraulic adjusting elements 20, 21 comprise bushes with cylinder bores, in which pistons 27, 28 are guided. Moreover, the bushes define cylinder spaces. The cylinder spaces are filled with a hydraulic pressure fluid, particularly a hydraulic oil.

The oil cylinders of the adjusting elements 20, 21 are preferably designed in such a manner that a piston area of a piston 27 or 28 divides a respective cylinder space in two, namely into an upper region 25 or 26 and a lower region 29 or 30 of the cylinder space. In that case, at least the lower region 29, 30 is filled with pressure fluid. The upper region 25, 26 is possibly also filled with pressure fluid. In this regard, the two upper regions 25 and 26 of the cylinder spaces are connected together by way of a connecting line 51 and the two lower regions 29 and 30 of the cylinder spaces are connected together by way of a connecting line 31.

The lower region 29, 30 of a cylinder space represents a working region in which the pressure in the pressure fluid is built up for adjustment of the first elevator cage 15. The pressure in a lower region 29, 30 of a cylinder space is therefore relatively high, namely in the vicinity of 100 or several 100 bars. The upper region 25, 26 of a cylinder space, thereagainst, serves for damping an abrupt stroke movement such as can occur, for example, in the case of safety braking. The pressure in an upper region 25, 26 of a cylinder space is therefore relatively low and amounts to approximately 1 to 2 bars.

Moreover, hydraulic adjusting elements 32, 33 are provided for the second elevator cage 16. The hydraulic adjusting elements 32, 33 are arranged between the cross beam 19 and the second elevator cage 16. In this regard the hydraulic adjusting elements 32, 33 are connected on the one hand with the cross beam 19 and on the other hand with a top plate 34 of the second elevator cage 16.

The hydraulic adjusting elements 32, 33 are similarly designed as hydraulic oil cylinders. In that case the hydraulic adjusting elements 32, 33 comprise bushes. The bushes in turn have cylinder bores in which pistons 37, 38 are guided. Moreover, the bushes define cylinder spaces. The cylinder spaces are filled with a hydraulic pressure fluid, particularly a hydraulic oil. The adjusting elements 32, 33 or the oil cylinders thereof are possibly constructed to be equivalent in function to those of the adjusting elements 20, 21.

Here, too, a piston area of a piston 37, 38 therefore divides a respective cylinder space into two, namely into an upper region 35 or 36 and a lower region 39 or 40 of the cylinder space. In that case, at least the lower region 39, 40 is filled with pressure fluid. The upper region 35, 36 is possibly also filled with pressure fluid. In this regard the two upper regions 35 and 36 of the cylinder spaces are connected together by way of a connecting line 71 and the two lower regions 39, 40 of the cylinder spaces are connected together by way of a connecting line 41. A lower region 39, 40 or an upper region 35, 36 of a cylinder space similarly stands under a high or low pressure.

The second elevator cage 16 can be adjusted upwardly in an adjustment direction 61 and downwardly in an adjustment direction 62. The adjustment directions 61, 62 are in this regard oriented parallel to the travel directions 11, 12 of the elevator cage carrier 2.

A hydraulic connection 42 is formed between the hydraulic adjusting elements 20, 21 and the hydraulic adjusting elements 32, 33 by way of a hydraulic line 42. In that case, at least the lower regions 29, 30, 39, 40 of the cylinder spaces or the hydraulic adjusting elements 20, 21, 32, 33 are connected. A connection between the lower regions 29, 30 of the hydraulic adjusting elements 20, 21 and the lower regions 39, 40 of the hydraulic adjusting elements 32, 33 is freed or blocked by way of the hydraulic connection 42 depending on the respective switch setting of a switching valve unit 43.

For that purpose the switching valve unit 43 comprises a blocking valve 50 and a switching magnet 49. The blocking valve 50 is so switchable by means of the switching magnet 49 that it frees or blocks the hydraulic connection 42. In the case of adjustment of the elevator cages 15, 16 in the adjustment directions 23, 62 or 24, 61 the blocking valve 50 frees the hydraulic connection 42. In a rest setting of the two elevator cages 15, 16, thereagainst, the blocking valve 50 blocks the hydraulic connection 42. The switching magnet is designed to be secure against failure. The switching magnet 49 therefore frees the blocking valve 50 only in the case of application of a switching current. In the case of power failure, thereagainst, the switching magnet 49 blocks the blocking valve 50. For that purpose the switching magnet 49 is in operative contact with a restoring spring which resets the switching magnet 49 in a blocking direction of the blocking valve 50.

Moreover, a pump 48 is arranged in the hydraulic connection 42 between the working regions 29, 30, 39, 40 of the hydraulic adjusting elements 20, 21 and the hydraulic adjusting elements 32, 33. In that case the pump 48 for raising and lowering the first elevator cage 15 or for lowering and raising the second elevator cage 16 relative to the elevator cage carrier 2 conveys pressure fluid from the working regions 29, 30 of the hydraulic adjusting elements 21, 22 for the first elevator cage 15 to the working regions 39, 40 of the hydraulic adjusting elements 20, 21 for the second elevator cage 16 or conversely.

The pump 48 is so designed that depending on the respectively desired adjustment direction of the elevator cages 15, 16 it conveys either pressure fluid from the working regions 29, 30 of the hydraulic adjusting elements 20, 21 to the working regions 39, 40 of the hydraulic adjusting elements 32, 33 or pressure fluid in the opposite direction, namely conveys from the working regions 39, 40 of the hydraulic adjusting elements 32, 33 to the working regions 29, 30 of the hydraulic adjusting elements 20, 21. The pump 48 thus has available two conveying directions. In specific cases of loading of the first and second elevator cages 15, 16 the pump 48 is also usable as a throttling element.

For that purpose the pump 48 is connected by way of a drive shaft with a speed-regulated motor 47. The torque, which is delivered by the motor 47 to the pump 48, for adjusting the first or the second elevator cage 15, 16 largely depends on the acceleration of the elevator cages 15, 16 as well as the load in conjunction with the adjustment direction of the first or second elevator cage 15, 16. The load results from a difference between the instantaneous loading of the first and second elevator cages 15, 16.

The weight force of the first elevator cage 15 and in a given case a loading of the first elevator cage 15 load the hydraulic adjusting elements 20, 21. Correspondingly, the weight force of the second elevator cage 16 and in a given case a loading of the second elevator cage 16 load the hydraulic adjusting elements 32, 33.

If, for example, the loading of the first elevator cage 15 is greater than that of the second elevator cage 16 a pressure p1 of the hydraulic fluid in the working regions 29, 30 of the hydraulic adjusting elements 20, 21 is greater than a pressure p2 of the pressure fluid in the working regions 39, 40 of the hydraulic adjusting elements 32, 33.

In this situation the motor 47 has to overcome a greater or lesser load depending on the respective conveying direction of the pump 48. If pressure fluid is conveyed into the adjusting unit 20, 21 at the higher pressure p1, then the motor has to exert a higher level or torque than if pressure fluid were to be conveyed into the adjusting unit 32, 33 at the lower pressure p2. In the case of a greater difference in 30 loading between the first and second elevator cages 15, 16 with correspondingly large pressure difference the pump 48 is also usable as a throttling element in order to limit the throughflow amount of the pressure fluid from the working regions 29, 30 of the hydraulic adjusting elements 20, 21 to the working regions 39, 40 of the hydraulic adjusting elements 32, 33.

Depending on the respective loading of the first and second elevator cages 15, 16 a different pressure distribution is possible in which, for example, the pressure p2 is greater than the pressure p1. Correspondingly different preconditions for the motor for exertion of torque 47 result therefrom.

For example, in the case of lowering the first elevator cage 15 on the one hand the pistons 27, 28 of the hydraulic adjusting elements 20, 21 move in the adjustment direction 24. On the other hand, the pistons 37, 38 of the hydraulic adjusting elements 32, 33 move in the adjustment direction 61. Since the pressure fluid displaced from the working regions 29, 30 of the hydraulic adjusting elements 20, 21 flows into the working regions 39, 40 of the hydraulic adjusting elements 32, 33 a synchronous movement on the one hand of the hydraulic adjusting elements 20, 21 and on the other hand of the hydraulic adjusting elements 32, 33 in the adjustment direction 24 or 61 is achieved. In this regard, the hydraulic adjusting elements 20, 21 and the hydraulic adjusting elements 32, 33 are designed to be matched to one another. In the case of lowering of the second elevator cage 16 the movement of the pistons, 27, 28, 37, 38 or the flow direction of the pressure fluid reverses.

In a rest setting of the elevator cages 15, 16 the connection between the hydraulic adjusting elements 32, 33 and the hydraulic adjusting elements 20, 21 is blocked by way of the hydraulic line 42. As a result, no exchange of pressure fluid between, on the one hand, the working regions of the hydraulic adjusting elements 32, 33 and, on the other hand, the working regions of the hydraulic adjusting elements 20, 21 takes place. Consequently, on the one hand an adjustment of the pistons 27, 28 of the hydraulic adjusting elements 20, 21 is blocked and thus prevented. On the other hand an adjustment of the pistons 37, 38 of the hydraulic adjusting elements 32, 33 is also blocked and thus prevented. The pressure fluid is, in particular, an incompressible pressure fluid. A reliable fixing of the position of the first and the second elevator cages 15, 16 relative to the elevator cage carrier 2 is thus made possible.

The adjustment of the elevator cages 15, 16 is controlled by a control unit 46. For that purpose the control unit 46 has available data of a first position measuring unit 72, a second position measuring unit 73, at least one first load measuring unit 78, 79 and at least one second load measuring unit 80, 81. The first position measuring unit 72 and the first load measuring unit 78, 79 are associated with the first elevator cage 15. The second position measuring unit 73 and the second load measuring unit 80, 81 are associated with the second elevator cage 16. The control unit 46 thus always knows the positions of the first and second elevator cages 15, 16 relative to the elevator cage carrier 2 and equally knows an instantaneous loading of the first and the second elevator cages 15, 16. In addition, the control unit 46 communicates with an elevator control and has available data with respect to which story will be moved to next and what cage spacing 77 between the elevator cages 15, 16 for this story is to be set.

By means of these data the control unit 46 presets for the motor 47 a torque in order, for a given loading, to set the cage spacing 77 between the elevator cages 15, 16 correctly in terms of time. By way of the position measuring units 72, 73 the control unit 46 has available the current positions of the elevator cages 15, 16 during adjustment and shuts down the motor 47 on attainment of the predetermined cage spacing 77. In addition, the control unit 46 controls the switching magnet 49 in such a manner that the blocking valve 50 frees the hydraulic connection 42 during the adjustment of the cage spacing 77 and blocks the hydraulic connection 42 after attainment of the predetermined cage spacing 77.

Moreover, the hydraulic connection 42 is supplied by an auxiliary pump 14 with additional pressure fluid. In that case, the auxiliary pump 44 conveys pressure fluid from an oil reservoir 45 into the hydraulic connection 42. This additional supply with pressure fluid takes place in order to compensate for oil losses. For that purpose the auxiliary pump 44 is activated by the control unit 46. Normally, a subtraction of the position values of the first position measuring unit 72 and the second position measuring unit 73 in a case of synchronous adjustment of the elevator cages 15, 16 in opposite sense represents a constant value. With progressing loss of oil, this value varies within a certain scope. The control unit 46 detects exceeding of a predetermined critical variation of this value and instructs the auxiliary pump 44 to convey pressure fluid until compensation is provided for the oil loss.

Furthermore, the upper regions 25, 26 of the hydraulic adjusting elements 20, 21 and the upper regions 35, 36 of the hydraulic adjusting elements 32, 33 are connected by way of a hydraulic connection 52. In that case, in correspondence with the adjustment direction of the first and second elevator cages 15, 16 pressure fluid flows the upper regions 25, 26 of the adjusting elements 20, 21 into the upper regions 35, 36 of the adjusting elements 32, 33 and conversely. Since the pistons 27, 28 reduce the volume of the upper regions 25, 26 of the adjusting elements 20, 21 the volume of the upper regions 35, 36 in the case of a given stroke of the elevator cages 15, 16 and in the case of the same diameter of the upper regions 25, 26, 35, 36 is greater. The hydraulic connection 52 is therefore connected with a pressure store 54. The pressure store 54 provides interim storage of excess pressure fluid from the upper regions 35, 36 when the pressure fluid flows from the upper regions 35, 36 of the hydraulic adjusting elements 32, 33 into the upper regions 25, 26 of the hydraulic adjusting elements 20, 21. If the pressure fluid flows in the opposite direction the pressure store 54 delivers stored pressure fluid back to the hydraulic connection 52.

Alternatively, it is possible to dispense with an additional pressure store 54 if the diameters of the upper regions 25, 26 of the adjusting elements 20, 21 are designed to be appropriately larger in size.

The pressure store 54 is possibly coupled with the hydraulic connection 52 by way of throttle valve 53. The throttle valve 53 limits the flow speed of the pressure fluid into the pressure store 54 and out of the pressure store 54 so that in a case of an abrupt stroke of the elevator cages 15, 16, such as, for example, when safety braking of the elevator cage carrier 2 takes place, enough pressure fluid always remains in the upper regions 25, 26, 35, 36 in order to achieve sufficient damping of the abrupt stroke.

Since for the same reasons a volume difference between the working regions 29, 30 of the hydraulic adjusting element 20, 21 and the working regions 39, 40 of the hydraulic adjusting elements 32, 33 exists the hydraulic connection 42 is possibly connected with a further pressure store and a further throttle valve. As above, alternatively thereto it is also possible to dispense with an additional pressure store together with throttle valve if the diameters of the working regions 39, 40 of the adjusting elements 32, 33 are designed to be appropriately larger in size.

The first elevator cage 15 has an alighting level 75. The second elevator cage 16 has an alighting level 76. The alighting levels 75, 76 can be determined by way of, for example, floor coverings of the elevator cages 15, 16. A cage spacing 77 is determined between the alighting level 75 of the first elevator cage 15 and the alighting level 76 of the second elevator cage 16. If the two elevator cages 15, 16 are respectively stopped relative to the elevator cage carrier 2, which is the case in the switch settings 50 of the switching valve unit 43, then the cage spacing 77 remains constant even during travel of the elevator cage carrier 2 through the travel space 3. The cage spacing 77 can be varied by adjustment of the first elevator cage 15 and the second elevator cage 16.

A story spacing between the stories 4, 5 depends on the architectural conditions of the building or the like. In this regard, the spacing of two successive stories within a building can vary. For example, in part false floors for accommodation of an air conditioning unit can be provided in the building. Moreover, the story spacing can be different with respect to a basement from a story spacing of the upper floors. Moreover, an entrance lobby can also predetermine a greater story height.

The elevator installation 1 enables adaptation of the cage spacing 77 to the story spacing of the stories 4, 5 to which travel is to be undertaken. Thus, a variation of the cage spacing 77 can be carried within the building. Architectural freedoms can thereby be increased. Since the two elevator cages 15, 16 can be moved, in particular, towards or away from one another several possible features arise. Through adjustment of the first elevator cage 15 in the adjustment direction 23 and the second elevator cage 16 in the adjustment direction 62 the elevator cages 15, 16 are to be moved towards one another and the cage spacing 77 is shortened. Since both elevator cages 15, 16 are adjusted, the cage spacing 77 changes by the sum of the speeds of the individual adjusting movements of the elevator cages 15, 16. This applies correspondingly to an increase in the cage spacing 77, in which the first elevator cage 15 is moved in the adjustment direction 24 and the second elevator cage 16 is moved in the adjustment direction 61. A further advantage is that the possible change in the cage spacing 77, i.e. the difference between a maximum cage spacing 77 and a minimum cage spacing 77, is made up from the possible adjustment movements for the elevator cages 15, 16. In this regard, the possible stroke for the hydraulic adjusting elements 20, 21 for the first elevator cage 15 and the possible stroke for the hydraulic adjusting elements 32, 33 for the second elevator cage 16 are added to the possible change in the cage spacing 77. This means that the constructional demands on the hydraulic adjusting elements 20, 21, 32, 33 can be reduced for several reasons. On the one hand, bending forces or the like which occur are reduced in the pistons and bushes, which are now of shorter design, of the adjusting elements when shocks occur transversely to the travel directions 11, 12. In addition, the structural stability of the adjusting elements is generally higher. Thanks to the smaller resulting oil columns in the respective cylinder spaces the demands on seals and valves are also reduced. Moreover, the constructional design is simplified with respect to safety demands, which require a robust design also for the case of an emergency stop or the like. This also makes it possible to be able to eliminate special safety brake or brake devices which safety-brake or brake the elevator cages 15, 16 relative to the elevator cage carrier.

It is thus possible to create an elevator installation 1 with an elevator cage carrier 2 which receives two or more elevator cages 15, 16. In this regard, compensation can be provided for different spacings between stories 4, 5 within the building.

In the case of a combination of the adjusting movements of the elevator cages 15, 16 a relatively rapid adjustment of the two elevator cages 15, 16 relative to one another can take place. The good efficiency of the hydraulic pump 48 in this regard enables advantageous conversion of the energy, which is required for pumping, for raising the respective elevator cage 15, 16.

A possible advantage of at least some embodiments is the hydraulic communication between the first adjusting elements 20, 21 of the first elevator cage 15 and the adjusting elements 32, 33 of the second elevator cage 16. In this regard, the weight force of the first elevator cage 15 balances the weight force of the second elevator cage 16 or the pressure difference between p1 and p2 in the adjusting elements 20, 21, 32, 33 is kept small. This can mean that the conveying output, which is to be provided, of the pump 48 is equally small. Correspondingly, use can be made of smaller and lighter pumps. This can lead to a further reduction in weight of the movable mass of the elevator installation and to energy savings in operation.

The invention is not restricted to the described exemplifying embodiments.

In particular, the hydraulic adjusting elements 20, 21 of the first elevator cage 15 in a further arrangement are mountable on the lower cross beam 18 and the hydraulic adjusting elements 32, 33 of the second elevator cage 16 on the middle cross beam 17. In a further arrangement the hydraulic adjusting elements 20, 21 of the first elevator cage 15 are mountable on the middle cross beam 17 and the hydraulic adjusting elements 32, 33 of the second elevator cage 16 are mountable on the upper cross beam 19. In a further arrangement, not only the hydraulic adjusting elements 20, 21 of the first elevator cage 15, but also the hydraulic adjusting elements 32, 33 of the second elevator cage 16 are mountable on the middle cross beam 17.

The two first-mentioned further arrangements of the adjusting elements 20, 21 and 32, 33 are possibly designed with respect to the volume of the working regions 29, 30 and 39, 40 as well as the upper regions 25, 26 and 35, 36, because in these arrangements these volumes are substantially equal, since the crosswise effect of the volume reduction of the pistons 27, 28 and 37, 38 is eliminated. Consequently, in these arrangements a pressure store 54 and a throttle valve 53 in the hydraulic connections 42 and 52 are superfluous.

In addition, the hydraulic adjusting elements 20, 21, 32, 33 can be so designed that each elevator cage 15, 16 has merely one hydraulic adjusting element. The connecting lines 31, 51, 41, 71 are then redundant.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator installation, comprising:

an elevator cage carrier, the elevator cage carrier being disposed in a travel space;

a first elevator cage arranged at the elevator cage carrier;

a second elevator cage arranged at the elevator cage carrier;

a first hydraulic adjusting element, the first hydraulic adjusting element being configured to raise or lower the first elevator cage relative to the elevator cage carrier;

a second hydraulic adjusting element in fluid communication with the first hydraulic adjusting element, the second hydraulic adjusting element being configured to raise or lower the second elevator cage relative to the elevator cage carrier, the fluid communication between the first and second hydraulic adjusting elements being configured to convert raising or lowering of the first elevator cage by the first hydraulic adjusting element in a first adjustment direction into raising or lowering of the second elevator cage by the second hydraulic adjusting element in a second adjustment direction, the first and second adjustment directions being opposite directions.

2. The elevator installation of claim 1, a possible stroke of the first hydraulic adjusting element for adjusting the first elevator cage being approximately equal to a possible stroke of the second hydraulic adjusting element for adjusting the second elevator cage.

3. The elevator installation of claim 1, the first adjustment direction and the second adjustment direction being parallel to a travel direction of the elevator cage carrier in the travel space.

4. The elevator installation of claim 1, the first and second elevator cages being configured for synchronous adjustment relative to the elevator cage carrier.

5. The elevator installation of claim 1, further comprising:

a hydraulic connection between the first hydraulic adjusting element and the second hydraulic adjusting element; and a pump, the pump being configured to move fluid between the first and second hydraulic adjusting elements.

6. The elevator installation of claim 5, the hydraulic connection comprising a blocking valve.

7. The elevator installation of claim 5, the first hydraulic adjusting element comprising a first upper working region and a first lower working region, the first upper working region and the first lower working region being separated by a first piston, the second hydraulic adjusting element comprising a second upper working region and a second lower working region, the second upper working region and the second lower working region being separated by a second piston, the first and second lower working regions being connected by the hydraulic connection.

8. The elevator installation of claim 1, further comprising:

a hydraulic connection between the first hydraulic adjusting element and the second hydraulic adjusting element; and a blocking valve for the hydraulic connection, the blocking valve being configured to block the hydraulic connection when the first and second elevator cages are at rest relative to the elevator cage carrier.

9. The elevator installation of claim 1, the elevator cage carrier comprising a first cross beam arranged below the first elevator cage and a second cross beam arranged above the second elevator cage, the first hydraulic adjusting element being arranged at the first cross beam, and the second hydraulic adjusting element being arranged at the second cross beam.

10. An elevator installation, comprising:

an elevator cage carrier, the elevator cage carrier being disposed in a travel space and including first and second cross beams;

a first elevator cage arranged at the elevator cage carrier with the first cross beam arranged below the first elevator cage;

a second elevator cage arranged at the elevator cage carrier with the second cross beam arranged above the second elevator cage;

a first hydraulic adjusting element arranged at the first cross beam, the first hydraulic adjusting element being configured to raise or lower the first elevator cage relative to the elevator cage carrier;

a second hydraulic adjusting element arranged at the second cross beam, the second hydraulic adjusting element being configured to raise or lower the second elevator cage relative to the elevator cage carrier, a hydraulic connection between the first hydraulic adjusting element and the second hydraulic adjusting element, the hydraulic connection configured to allow a fluid communication between the first hydraulic adjusting element and the second hydraulic adjusting element; and a pump, the pump being configured to move fluid between the first and second hydraulic adjusting elements, the first and second hydraulic adjusting elements being configured to convert raising or lowering of the first elevator cage by of the first hydraulic adjusting element in a first adjustment direction into raising or lowering of the second elevator cage by the second hydraulic adjusting element in a second adjustment direction, the first and second adjustment directions being opposite directions.

* * * * *